United States Patent [19]

Reed

[11] 4,143,797

[45] Mar. 13, 1979

[54] METERING DISPENSER WITH CHILD RESISTANT, TIGHTLY SEALING CLOSURE

[75] Inventor: Richard B. Reed, Cincinnati, Ohio

[73] Assignee: The Procter & Gamble Company, Cincinnati, Ohio

[21] Appl. No.: 603,555

[22] Filed: Aug. 11, 1975

[51] Int. Cl.[2] ..... B65D 37/00

[52] U.S. Cl. ..... 222/207; 222/546

[58] Field of Search ..... 222/109, 182, 205, 207, 222/211, 563, 545, 546, 564; 215/216, 217, 222, 9

[56] References Cited

U.S. PATENT DOCUMENTS

| | | | |
|---|---|---|---|
| 2,599,446 | 6/1952 | Greene | 222/205 |
| 2,714,975 | 8/1955 | Greene | 222/205 |
| 3,124,281 | 3/1964 | Stull | 222/546 X |
| 3,246,807 | 4/1966 | Micall et al. | 222/207 |
| 3,378,168 | 4/1968 | Hildebrandt | 222/545 X |
| 3,613,928 | 10/1971 | Landen | 215/222 X |
| 3,623,623 | 11/1971 | Bauer | 215/222 |
| 3,762,612 | 10/1973 | Miller | 222/545 X |
| 3,830,413 | 8/1974 | Birrell | 222/563 |
| 3,880,314 | 4/1975 | Akers | 215/222 X |
| 3,921,860 | 11/1975 | Zackheim | 222/207 |

FOREIGN PATENT DOCUMENTS

| | | | |
|---|---|---|---|
| 922188 | 3/1963 | United Kingdom | 222/546 |

*Primary Examiner*—Joseph F. Peters, Jr.
*Assistant Examiner*—Norman L. Stack
*Attorney, Agent, or Firm*—John V. Gorman; Richard C. Witte; Thomas H. O'Flaherty

[57] ABSTRACT

Fitment and closure for the mouth of a bottle comprising an open top cup with a tube extending axially upwardly through the bottom wall less than the depth of the cup and molded of a soft material such as polyethylene and comprising a circular base and a depending skirt with the interior of the skirt and the exterior of the bottle finish being provided with cooperating locking lugs, the cap sealing the fitment by means of an inner seal that engages the top portion of the tube and an outer seal that engages inside the cup rim with the inner seal engagement depressing the tube to flex the bottom wall of the cup to bias the locking lugs to provide push and turn child resistance and enabling the closure cap to be made of integral one-piece molded construction of a relatively rigid material, such as polypropylene.

5 Claims, 4 Drawing Figures

METERING DISPENSER WITH CHILD RESISTANT, TIGHTLY SEALING CLOSURE

FIELD OF THE INVENTION

This invention relates to a squeeze bottle metering dispenser with a child resistant, tightly sealing closure.

DESCRIPTION OF THE PRIOR ART

Metering dispensers utilizing a cup-like fitment having a dip tube extended upwardly through the bottom wall for insertion into the mouth of a squeeze bottle have been suggested in the prior art, for example, in Greene U.S. Pat. No. 259,446. The closure of the metering chamber of this type by means of a cap having a simple annular friction seal has also been heretofore suggested in Greene U.S. Pat. No. 2,714,975.

Push and turn type child resistant closures utilizing interengaging camming type lugs to provide the locking action have also been heretofore suggested, for example, in Hedgewick Re-Issue U.S. Pat. No. Re. 27,156 and Bauer U.S. Pat. No. 3,623,623.

The aforesaid Hedgewick Re-Issue U.S. Pat. No. Re. 27,156 discloses a safety cap and container wherein a plurality of container-locking elements or lugs are spaced peripherally from each other on the outer wall of the mouth portion of the container for engagement with complementary cap locking elements or lugs on the inner wall of a peripheral skirt which projects axially from the base of the cap. The cap and container locking elements are of the type wherein the cap must be engaged with and disengaged from the container by combined axial and rotative motion of the cap relative the container. When the cap is mounted on the container, the cap locking elements are biased against disengagement from the container locking elements by a spring member in the form of an integral annular web formed in the cap.

In the aforesaid Bauer U.S. Pat. No. 3,623,623 a similar cap locking arrangement is provided but the biasing means comprises a separate domed element carried by the container for resiliently maintaining the cap in interlocked engagement with the container.

In both the Hedgewick Re-Issue U.S. Pat. No. Re. 27,156 and the Bauer U.S. Pat. No. 3,623,623 the sealing of the container is achieved by means of the engagement between the annular spring element of the cap against the container mouth and of the dome spring element against the cap, respectively. Hence, in each of these prior art patents the spring member provides both biasing of the locking elements and sealing of the container mouth. The optimum biasing forces for each of these two functions are not identical and, therefore, these arrangements require that the resilience of the spring element be selected by compromise between the desired optimums for sealing and biasing of the locking members.

OBJECTS OF THE INVENTION

Bearing in mind the foregoing, it is a primary object of the present invention to provide a novel and improved metering dispenser with a child resistant, tightly sealing closure.

Another primary object of the present invention, in addition to the foregoing object, is the provision of such novel and improved apparatus utilizing biasing means integral with the metering dispenser and sealing means separate and independent thereof.

Another primary object of the present invention, in addition to each of the foregoing objects, is the provision of such apparatus wherein the closure is of integral, one-piece molded construction.

Yet another primary object of the present invention, in addition to each of the foregoing objects, is the provision of such apparatus wherein the closure may be made of a relatively rigid material such as polypropylene, or the like, and the metering dispenser may comprise a fitment made of a relatively less rigid material such as polyethylene, or the like.

Still another primary object of the present invention, in addition to each of the foregoing objects, is the provision of novel sealing closures for metering dispensers.

Yet still another primary object of the present invention, in addition to each of the foregoing objects, is the provision of a child resistant closure for a metering dispenser of the type herein disclosed.

The invention resides in the combination, construction, arrangement and disposition of the various component parts and elements incorporated in new and improved metering dispensers with child resistant, tightly sealing closures constructed in accordance with the principles of this invention. The present invention will be better understood and objects and important features other than those specifically enumerated above will become apparent when consideration is given to the following details and description which, when taken in conjunction with the annexed drawing describes, discloses, illustrates and shows a preferred embodiment or modification of the present invention and what is presently considered and believed to be the best mode of practicing the principles thereof. Other embodiments or modifications may be suggested to those having the benefit of teachings herein, and such other embodiments or modifications are intended to be expressly reserved, especially as they fall within the scope and spirit of the subjoined claims.

SUMMARY OF THE INVENTION

Metering fitment inserted into the mouth of a squeeze bottle for dispensing measured quantities of a liquid therefrom and child resistant, tightly sealing closure cooperating therewith. The metering insert comprises an open top cup with a dip tube extending axially upwardly through the bottom wall less than the depth of the cup. Upon squeezing of the bottle, liquid content is forced upwardly through the dip tube into the cup and upon release of squeeze pressure, part of the liquid in the cup automatically drains back through the dip tube to retain a measured quantity of liquid in the cup defined by the height of the dip tube and the diameter of the cup. The metering insert may be molded of a soft material such as polyethylene or may be of such a design that it flexes vertically upon engagement with a stem being integrally molded therewith defining the upper end of the dip tube and the child resistant closure is of the push and turn type cooperating with the metering fitment and the bottle finish. The closure comprises a circular base and a depending skirt with the interior of the skirt and the exterior of the bottle finish being provided with cooperating locking lugs. The closure provides sealing by means of two annular axially extending seals, an inner seal that engages the top portion of the dip tube and an outer seal that engages inside the metering cup rim. In addition, the inner seal engagement with the upper end portion of the dip tube flexes the bottom wall of the metering cup to provide spring action for the locking lugs. The closure cap can be made of a relatively rigid material, such as polypropylene, or the like, and be of one-piece molded construction. The fitment can also be of one-piece molded construction of a relatively resilient material such as low density polyethylene, or the like, with the dip tube separately assembled therewith. The materials of the various component parts and elements need not necessarily be critical.

DESCRIPTION OF THE DRAWING

While the specification concludes with the claims particularly pointing and distinctly claiming the subject matter which is regarded as forming the present invention, it is believed the invention will be better understood from the following detailed description when taken in conjunction with the annexed drawing which discloses, illustrates and shows a preferred embodiment or modification of the present invention and what is presently considered and believed to be the best most of practicing the principles thereof and wherein:

DETAILED DESCRIPTION OF THE INVENTION

Figure 1:
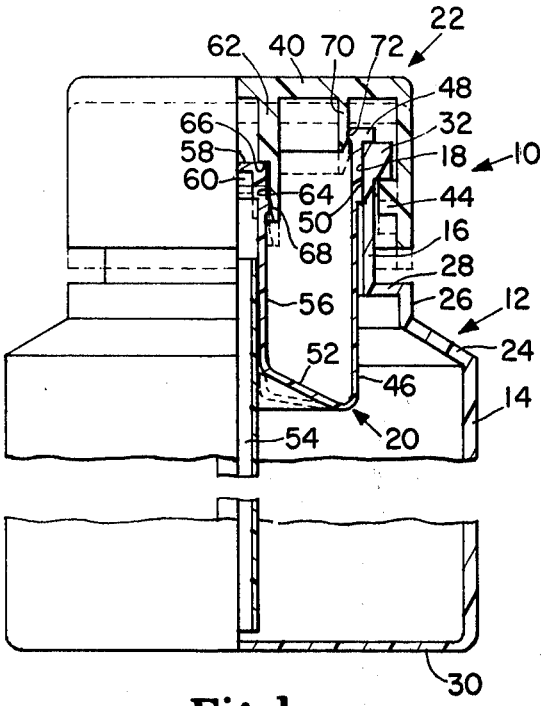
FIG. 1 is an elevational view, partially in section of a squeeze wall bottle provided with the metering dispensing and child resistant, tightly sealing closure of the present invention.
Figure 2:
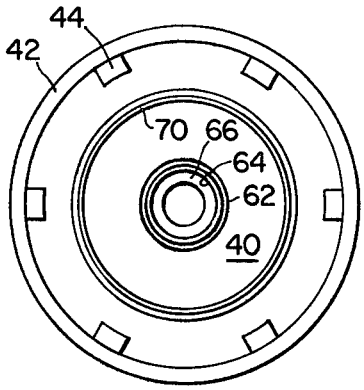
FIG. 2 is a plan view, viewed from the bottom, of the closure cap.

With reference now to the drawing, there is shown and illustrated a safety and metering package constructed in accordance with the principles of this invention designated generally by the reference character 10. The package 10 defines a metering dispenser for a liquid product with a child resistant, tight sealing closure. The package 10 comprises a squeeze bottle 12 having a flexible side wall 14 and a finish portion 16 connected therewith and having a generally open and unobstructed mouth portion 18; a metering fitment or insert 20 disposed within the mouth opening 18 of the finish 16 and a closure or cap 22 sealing engaging the metering fitment 20, as will be described hereinafter, and complementary locking elements provided on the closure 22 and bottle finish 16, respectively, as will also be hereinafter described.

The container or squeeze bottle 12 may be of substantially any desired shape or configuration and is herein shown, for exemplary purposes only, with the side wall 14 being of generally cylindrical configuration and connected with the bottle finish 16 by means of a sloped frusto-conical connecting wall portion 24, a generally cylindrical connecting wall portion 26 and a generally annular radially extending flange portion 28. The squeeze bottle or container 12 further comprises a generally circular bottom wall 30.

Figure 3:
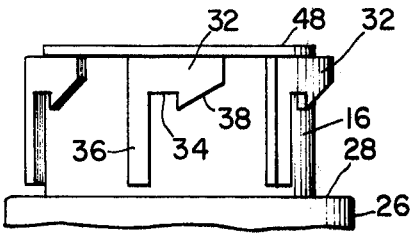
FIG. 3 is an elevational view of the squeeze bottle having the metering fitment positioned therein.
Figure 4:
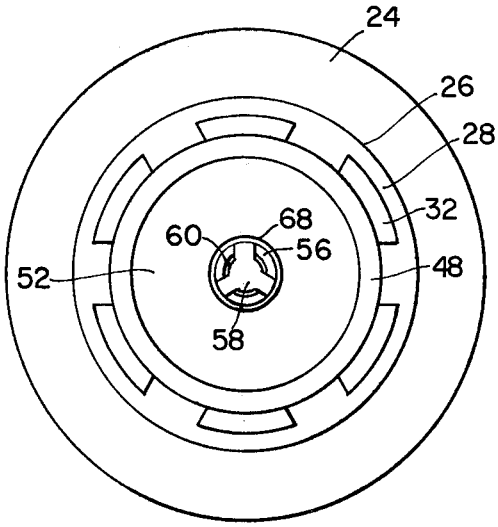
FIG. 4 is a top plan view of the squeeze bottle and metering fitment.

A plurality of container locking elements 32 are spaced peripherally from each other and are located at a fixed axial position around the bottle finish 16. The container locking elements 32 are of the type shown in the above-mentioned Hedgewick Re-Issue U.S. Pat. No. Re. 27,156 and each includes a radially outwardly extending projection formed with a notch 34 formed between a stop portion 36 and a cam portion 38 (FIG. 3).

The cap or closure 22 comprises an end wall 40 of generally circular configuration having a peripheral skirt 42 projecting axially therefrom for receiving the bottle finish 16 therewithin. Spaced peripherally from each other on the inner surface of the skirt portion 42 are a plurality of cap locking elements 44 in the form of radially inwardly projecting lugs. The cap locking elements 44 are engageable with and disengageable from the container locking elements 32 by an axial motion of the cap or closure 22 relative the container or squeeze bottle 12 followed successively by a rotative motion of the cap or closure 22 relative the container or squeeze bottle 12. To apply the cap or closure 22 to the container or squeeze bottle 12, the cap-locking elements 44 are aligned with the spaces between the container locking elements 32 so that the locking lugs 44 engage the cam surface of the cam portion 38 of the locking elements 32. Upon rotation of the cap or closure 22 in the direction to move the cap locking elements or lugs 44 toward the left in FIG. 3, the cap-locking elements or lugs 44 are cammed downwardly by the cam portion 48 until they engage the respective stop portion 36, at which point the lugs 44 come into alignment with the respective notches 34. Subsequent upward movement engages each cap locking element or lug 44 in a notch 34 to prevent relative rotation between the cap and container. The upward movement is provided by a biasing spring action developed by the metering insert or fitment 20 in cooperation with the closure or cap 22, as will be described hereafter.

The metering insert or fitment 20 is of generally cup shaped configuration having a generally cylindrical side wall portion 46 and provided at the upper end portion thereof with a generally radially outwardly extending flange portion or lip 48. The wall portion 46 generally adjacent the flange or lip 48 comprises a generally thickened annular shoulder 50 which fits tightly within the mouth opening 18 of the bottle finish 16 with the flange portion or lip 48 positioning the insert or fitment within the mouth portion 18 of the bottle finish 16 (FIG. 1).

The metering insert or fitment 20 further comprises a generally annular bottom wall portion of generally upwardly belled or frusto-conical configuration through which a dip tube 54 generally axially extends from the bottom of the container or bottle 12 to within the fitment 20 to some distance below the rim of the outer wall 46. The upper end portion of the dip tube 54 may be engaged within a stem portion 56 integrally formed with the bottom wall 52 of the fitment or insert 20. The upper end portion of the stem 56 may be provided with a top wall 58 and a plurality of sideways or radially directed orifices 60 arranged, for example, at 120° intervals around the distal end portion of the stem 56 so that liquid passing upwardly through the dip tube 54 and the stem 56 will be directed radially outwardly therethrough and precluded from squirting upwardly out of the mouth opening of the squeeze bottle 12.

The metering function of the package 10 operates as follows. Squeezing of the side wall 14 of the squeeze bottle 12 compresses the liquid contained therein and forces it upwardly through the dip tube 54 and radially outwardly through the orifices 60 into the generally annular well or cup formed by the metering insert or fitment 20. The bottle 12 is squeezed until the level of liquid within the cup or well defined by the insert or fitment 20 rises to or above the level of the orifices 60. Upon release of squeeze pressure from the squeeze bottle 12, the excess of liquid within the cup above the orifices 60 will drain downwardly through the dip tube 54 to retain a measured quantity of liquid within the fitment cup defined by the cup diameter and the depth of the cup beneath the orifices 60. The measured quantity of the liquid then contained within the fitment cup can be dispensed by tilting and inverting of the bottle 12 to pour the measured quantity of the liquid from the cup. Upon such inversion, the lower end portion of the dip tube 54 will be withdrawn from the liquid within the squeeze bottle 12 and lack of a separate vent to the bottle precludes dispensing of additional quantity of product outwardly through the dip tube 54.

The closure or cap 22 further comprises a generally centrally disposed generally axially depending stem 62 of generally cylindrical configuration depending from the top wall 40 generally coaxial the skirt portion 42 for engaging the stem portion 56 of the metering insert or fitment 20. The lower or distal end portion of the cap stem 62 is provided with a counterbore 64 extending to a shoulder or step 66. The counterbore 64 fits around the distal end portion of the fitment stem 56 and, in cooperation with a generally annular sealing ring or flange 68 extending generally circumferentially around the fitment stem 56 generally beneath the openings 60, that is, between the openings 60 and the fitment bottom wall 52, provides priming of inner sealing for closure of the openings 60 and the distal end of the fitment stem 56 when the cap or closure 22 is assembled with the bottle 12 with the cap locking elements 44 engaged within the notches 34 of the container locking elements 32.

The cap or closure 22 is further provided with secondary or outer sealing means defined by a sealing ring 70 depending from the face 40 of the cap or closure 22 generally coaxially with the cap stem 62 and cap skirt 42. The secondary sealing ring 70 extends into the metering cup or fitment 22 and slidably sealingly engages an inwardly directed and annular sealing rim ring 72 integrally formed with the metering fitment or insert adjacent the mouth thereof and opposite the locating flange 48.

As heretofore pointed out, biasing means are required for resiliently retaining the cap or closure 22 in interlocked engagement with the container finish 16. In accordance with the present invention such biasing means is integrally provided by the metering fitment or insert 20, independent of the sealing means 64 and 70. In accordance with the present invention the bottom wall 52 of the metering insert or fitment 20 is resilient and upwardly cupped or beveled to define a frusto-conical or belleville type spring carrying the fitment stem 56 at its inner edge. As has been heretofore pointed out, the upper end or distal wall 58 of the fitment stem 56 engages the shoulder 66 of the closure stem 62. Hence, upon depression of the closure cap 22 from the latched position, shown in solid lines in FIG. 1, wherein the closure lugs 44 are engaged within the notches 34 of the container lugs 32 to the unlatched position, shown in phantom lines in FIG. 1, whereat the closure lugs 44 clear the camming surface 38 of the container lugs 32, the bottom wall 52 of the metering fitment 20 flexes downwardly to the position shown in phantom lines in FIG. 1 and thereby provides the biasing force for the closure cap 22.

Accordingly, the metering cup or fitment 20 may be integrally molded as one-piece from a relatively resilient material cup such as low density polyethylene. The cap or closure 22, since it does not require any resilience or resilient elements, may be integrally molded from a relatively nonresilient material, such as polypropylene. Each of the primary and secondary sealing means tightly seals independent of the spring action by the engagement of the relatively resilient sealing rings 68 and 72 integrally molded with the metering fitment or insert 20 engaging against the relatively less resilient sealing surfaces of the cap stem 62 and seal ring 70.

While the invention has been described, disclosed, illustrated and shown in terms of a preferred embodiment or modification which it has assumed in practice, such other embodiments or modifications as may be suggested to those having the benefit of the teachings herein are intended to be expressly reserved especially as they fall within the scope and breadth of the claims here appended.

What is claimed is:

1. A child resistant package comprising a container having a generally cylindrical finish defining a generally open and unobstructed mouth opening and provided with a plurality of radially outwardly extending locking lugs, a cup-like fitment carried within said container finish and having a flexible and resilient bottom wall spaced apart from said container mouth opening and a dispensing stem carried by said bottom wall generally coaxially within said bottle finish and extending toward said mouth opening, and a closure cap having a skirt for surrounding said container finish and provided with a plurality of inwardly directed lugs for latching engagement with said container lugs and a central stem for engaging said dispensing stem, said dispensing stem having at least one dispensing orifice adjacent its distal end and said central stem being provided at its distal end with a closed end counterbore for receiving said dispensing stem distal end therewithin and a sealing flange extending generally annularly within said counterbore around said dispensing stem slidably sealingly engaging said dispensing stem generally annularly therearound and proximally of said dispensing orifice, said counterbore terminating at a generally annular shoulder, wherein engagement of said shoulder with the distal end of said dispensing stem depresses said stem and flexes said cup bottom wall to bias said closure cap outwardly of said container mouth and thereby lock said container and cap lugs against inadvertent disengagement and require that a child resistant push and turn motion be applied to open the package.

2. Child resistant package defined in claim 1 wherein said container lugs each comprise a notch opening axially away from said container mouth and said cap lugs each latch within a respective notch of a respective container lug.

3. Child resistant package defined in claim 2 wherein said fitment is of integral one piece construction with said bottom wall being of generally upwardly belled frustoconical configuration.

4. Child resistant package defined in claim 2 further comprising a generally radially outwardly extending lip along the periphery of said fitment for engaging the container mouth rim and thereby positioning said fitment therewithin.

5. Child resistant package defined in claim 2 further comprising an inwardly directed generally annular secondary sealing flange extending around said fitment generally adjacent the mouth opening thereof and a sealing ring carried by said cap generally coaxial said stem adapted to slidably sealingly engage said secondary sealing flange.

* * * * *